US005630734A

United States Patent [19]

Phillips, Jr.

[11] Patent Number: 5,630,734

[45] Date of Patent: May 20, 1997

[54] CONNECTOR WITH SOLDERLESS FILTER

[75] Inventor: William T. Phillips, Jr., Boardman, Ohio

[73] Assignee: General Motors Corporation, Detroit, Mich.

[21] Appl. No.: 571,616

[22] Filed: Dec. 13, 1995

[51] Int. Cl.[6] ..... H01R 13/66

[52] U.S. Cl. ..... 439/620; 333/182

[58] Field of Search ..... 439/620; 333/181–185

[56] References Cited

U.S. PATENT DOCUMENTS

| | | | |
|---|---|---|---|
| 4,772,224 | 9/1988 | Talend | 439/620 |
| 4,784,618 | 11/1988 | Sakamoto et al. | 439/620 |
| 5,213,522 | 5/1993 | Kojima | 439/620 |
| 5,219,305 | 6/1993 | Kawaguchi et al. | 439/620 |
| 5,224,878 | 7/1993 | Lurie et al. | 439/620 |
| 5,286,221 | 2/1994 | Fencl et al. | 439/620 |
| 5,415,569 | 5/1995 | Colleran et al. | 439/620 |
| 5,546,058 | 8/1996 | Azuma et al. | 439/620 |

FOREIGN PATENT DOCUMENTS

| | | | |
|---|---|---|---|
| 2631748 | 11/1989 | France | 439/620 |

*Primary Examiner*—Gary F. Paumen
*Attorney, Agent, or Firm*—Michael J. Bridges

[57] ABSTRACT

A solderless filter circuit disposed in an electrical connector assembly for filtering electrical signals carried by conductors in the connector assembly including, without solder connections, low cost capacitive and inductive circuit elements providing reliable electrical connection with the conductors, for example in a Pi filter configuration for low pass signal filtering in a convenient filter package. Integrated capacitor elements include modified electrical leads in the form of conductor seats and are packaged with a ferrite block in at least one housing retained within at least one of two mating connectors.

14 Claims, 3 Drawing Sheets

CONNECTOR WITH SOLDERLESS FILTER

FIELD OF THE INVENTION

This invention relates to electrical connectors and, more particularly to connectors with solderless electrical signal filters incorporated therein.

BACKGROUND OF THE INVENTION

Low pass filtering of electrical signals for removal of high frequency noise and disturbance signal content in noisy electronics environments, such as in automotive environments, is well-established. Low pass filter components may include such standard circuit components as capacitors and inductors arranged in a conventional Pi-filter configuration. The inductor filter component may be provided as a standard ferrite block through which conductive leads or pins may be driven to add series inductance to the leads or pins, which inductance may form the horizontal portion of the low-pass Pi-filter configuration. The vertical legs of the Pi-filter configuration may be provided as standard capacitors. Traditionally, such low pass filter components were installed on printed circuit boards, consuming precious board space. To free up printed circuit board space, such low pass filters have been integrated into header connectors which are attached to the printed circuit boards for interfacing printed circuit board input/output signals with wire harnesses. The wire harnesses may be attached, for example, to other electrical or electronics devices, such as sensors, actuator drivers, and electronics components of other printed circuit boards. The capacitors of such integrated low pass filters may be implemented as surface mount devices SMDs or discrete capacitor elements soldered to leads or conductive traces of a small printed circuit board substrate and assembled with the ferrite block into a plated plastic connector housing assembly. The housing assembly is installed in the header connector and electrically coupled to certain of the connector leads or pins requiring such low pass filtering.

Such conventional low pass filter mechanizations suffer shortcomings in the areas of cost, packaging and reliability. Discrete capacitor components are costly and consume significant connector space. Solder connections, required for both SMDs and discrete capacitor elements, add substantially to process costs, and are prone to cracking—especially under severe thermal cycling. For example, many header connectors can be cycled between such severe temperatures as −40 degrees Celsius and 125 degrees Celsius.

It would therefore be desirable to provide a solder-free, low cost and easily packaged low pass filter integrated into a header connector.

SUMMARY OF THE INVENTION

The present invention provides a low pass filter integrated into a connector, such as a header connector, without use of solder processes and in a convenient, low cost connector package.

More specifically, a low pass filter is provided, such as in a pi-filter configuration, including capacitor elements integrated on an integrated circuit having modified conductive pins or leads forming spring-loaded seats for receiving connector pins. The integrated capacitor circuit is installed in an interior cavity of a connector filter housing along with a ferrite block. Connector pins may, in accord with an aspect of this invention, be passed through the housing within which they seat in the modified integrated circuit pins, pass then through the ferrite block to a second set of modified integrated circuit pins in which they are seated. Signals carried by the connector pins are thereby passed through a filter process, such as a low pass filter process in a Pi filter configuration.

In yet a further aspect of this invention, the integrated circuit takes the form of a dual in-line package DIP with opposing pairs of modified output pins. Opposing pairs are aligned to form a pair of connector pin seats between which is provided a ferrite block passage through which the connector pins passes between the opposing pair.

In still a further aspect of this invention, the integrated circuit takes the form of a pair of single in-line packages SIPs both of which may be installed in the connector housing of a single connector. Still further, a first of the pair of SIPs may be installed in the connector housing with the ferrite block, and a second of the pair of SIPs may be installed on a corresponding connector to be mated with the connector containing the connector housing, so that minimum connector space of each of the mating connectors may be consumed by the filter components of the SIPs and the ferrite block.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
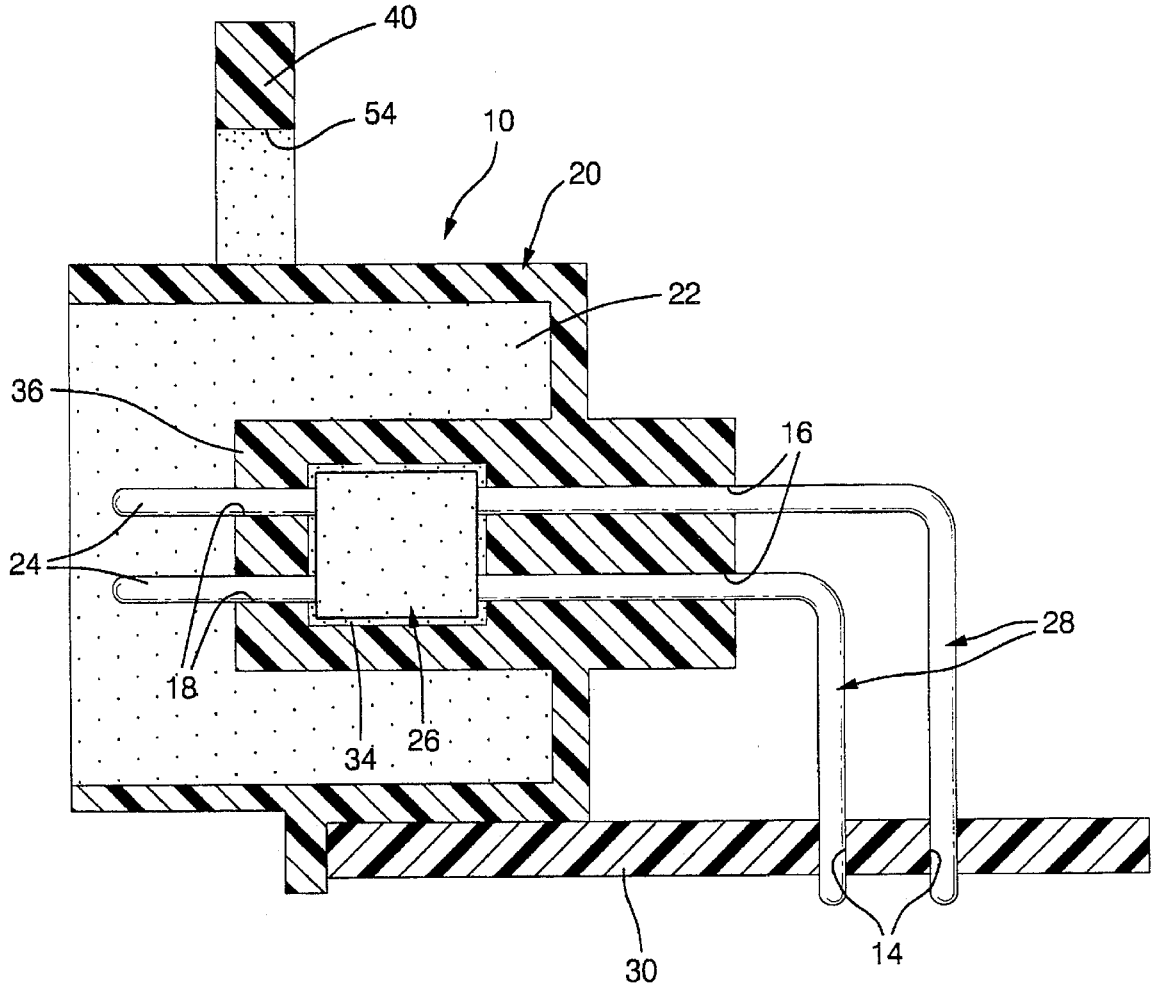
FIG. 1 is a side cutaway view of a solderless filter header connector assembly of the preferred embodiment.

Referring to FIG. 1, a side cutaway view of a novel solderless filter header connector assembly 10 having a hollow plastic connector housing 20 defining an interior cavity 22 sized to receive a female connector (not shown). The housing 20 includes a hollow projection 36 extending into cavity 22 and defining enclosure 34 in which is disposed a filter housing 26 containing a solderless filter assembly, to be described.

A plurality of passages 18 extend from the cavity 22 through the projection 36 and into the enclosure 34. A corresponding plurality of passages 16, aligned with the plurality of passages 18, extend from the enclosure 34 through the connector housing 20. A pin end 24 of an L-shaped, electrically conductive connector pin from the L-shaped pins 28 is passed, during installation of the connector assembly 10 to a printed circuit board 30, through a corresponding one of the passages 16, through the enclosure 34 and through a corresponding one of the passages 18 and extends into cavity 22 for mating with a conventional female connector (not shown). The mating of the pin ends 24 with the female connector may be carried out through any connector interface generally known in the art. The connector housing 20 may be secured, in this embodiment, to the printed circuit board 30 in any conventional manner, such as through a plurality of rivets (not shown) extending through the housing 20 and through the printed circuit board, and through soldering of the pins 28 to a corresponding series of plated holes 14 in the printed circuit board.

Generally, a series of conductive traces (not shown) may be disposed on the circuit board 30 to direct electrical signals between the circuitry (not shown) of the circuit board 30 and the pins 28, wherein each conductive trace terminates in a hole 14. Each of the plurality of pins 28 may be soldered to a corresponding one of the series of holes 14 during a wave solder process so that reliable electrical conduction between the pins 28 and the circuitry of the circuit board 30 may be assured. The electrical signals are then carried between the circuit elements of the circuit board 30 and external devices via the interface with a conventional female connector (not shown) and the pin ends 24.

Figure 2:
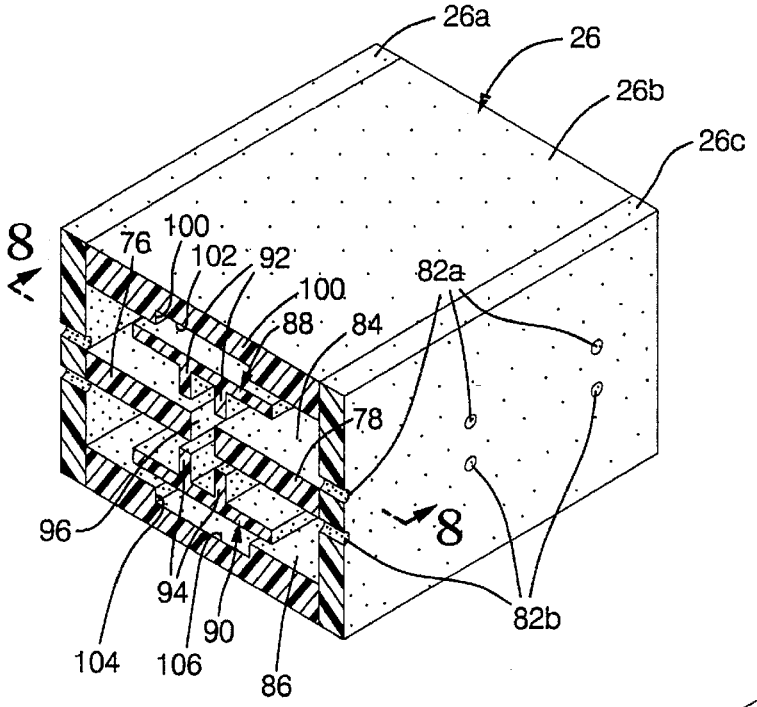
FIG. 2 is an orthogonal view of a filter housing incorporated into the connector assembly of FIG. 1.

FIG. 2 details an orthogonal cutaway view of the filter housing 26 of FIG. 1 having a center section 26*b* constructed of molded plastic with first and second end caps 26*a* and 26*c* on opposing sides of the center section 26*b*. The end caps 26*a* and 26*c* may be snapped on and/or glued to the molded center section 26*b* during a housing assembly process. The filter housing 26 includes a series of upper passages 82*a* and a series of lower passages 82*b* through the cross-section of the filter housing 26. The passages 82*a* and 82*b* of this embodiment are arranged to be aligned with the passages 16 and 18 of the connector 10 of FIG. 1 so that conductive pins 28 may be inserted through passages 16 and then through the passages 82*a* and 82*b* of the filter housing 26, and then through the passages 18 to extend into the cavity 22. For example, for a connector having upper and lower spaced pins, each of the upper passages 82*a* may be positioned a distance above a corresponding lower passage 82*b* forming upper and lower passage pairs along the length of the filter housing 26. A housing having six passages or three passage pairs is illustrated in FIG. 2 for filtering electrical signal content carried on six conductive pins 28 of FIG. 1. Generally, the number of passages of the filter housing 26 should correspond to the number of conductive pins carrying electrical signals requiring filtering, such as low pass filtering, in accord with the application of the solderless filter connector of this embodiment. Alternatively, the filter housing 26 may have upper and lower passages 82*a* and 82*b* therethrough for each of the pins 28 of the connector 10, with filter elements, to be described, only installed in the housing for those conductive pins carrying signals requiring filtering.

The upper passages open into upper interior cavity 84 of the filter housing 26 and the lower passages open into lower interior cavity 86 of the filter housing. The interior cavities 84 and 86 extend along the length of the filter housing 26. An upper plastic plate 88 extends along a length of the upper cavity 84 with spaced first and second legs 92 extending in a downward direction from the plate 88 along the length thereof thereby forming an upper channel bounded by the plate 88 surface and the two legs 92. Likewise, a lower plastic plate 90 extends along a length of the lower cavity 86 with spaced first and second legs 94 extending in an upward direction from the lower plate along the length thereof, thereby forming a lower channel bounded by the plate 90 and the two legs 94. A partition along the length of the filter housing 26 between the upper and lower interior cavities 84 and 86 includes a rectangular slot 96 which divides the partition into sections 76 and 78. The width of the rectangular slot 96 corresponds to and is aligned with the upper and lower channels between respective legs 92 and 94. The slot 96 extends along the housing 26 length and is sized to receive conventional rectangular ferrite block 120 of FIG. 3 having passages 122 through the cross-section thereof corresponding to the position of the passages of the filter housing 26 such that, when the ferrite block 120 is inserted into the rectangular slot 96, the passages 82*a* and 82*b* line up with the passages 122 through the ferrite block 120 to allow pins 28 of FIG. 1 to pass through the passages of the ferrite block when such pins are inserted into the connector 10 of FIG. 1, to provide a series inductive load on such pins in accord with the low pass filter of this embodiment.

The filter housing 26 includes a flat upper interior recess 102 defined by edges 100 in the housing 26, the recess extending along the length of the housing and positioned to face the upper plate 88. Likewise, the filter housing 26 includes a flat lower interior recess 106 defined by edges 104 in the housing 26, the recess extending along the length of the housing and positioned to face the lower plate 90.

Figure 4:
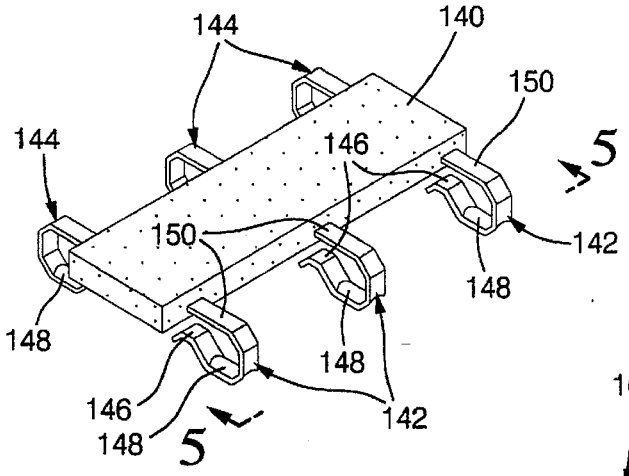
FIG. 4 is an orthogonal view of an upper integrated circuit containing capacitive circuit elements to be incorporated into the filter housing of FIG. 2.

Referring to FIG. 4, flat rectangular integrated circuit IC 140 of a conventional dual in-line package mechanization, having conductive pins or leads 142 and 144 is sized for slideable insertion into upper cavity 84 of filter housing 26 of FIG. 2, along the length thereof, between the flat plate 88 and the recess 102, seated between edges 100. The pins 142 and 144 may be constructed of a conventional conductive resilient spring steel material, such as stainless steel. As illustrated for one of the pins of FIG. 4 but applicable for all of the pins 142 and 144 of FIG. 4, each pin extends outward from the IC 140 in a flat pin section 150 into a "U" shape pin elbow into a horizontal pin section 148 having an arcuate cross-section which recedes into an inner horizontal pin section 146 which may have a flat cross-section. The construction of pins 144 corresponds to that described for pins 142. The number of pins 142 may correspond to the number of upper passages 82*a* of the filter housing 26 of FIG. 2. The number of pins 144 corresponds to the number of pins 142.

Figure 7:
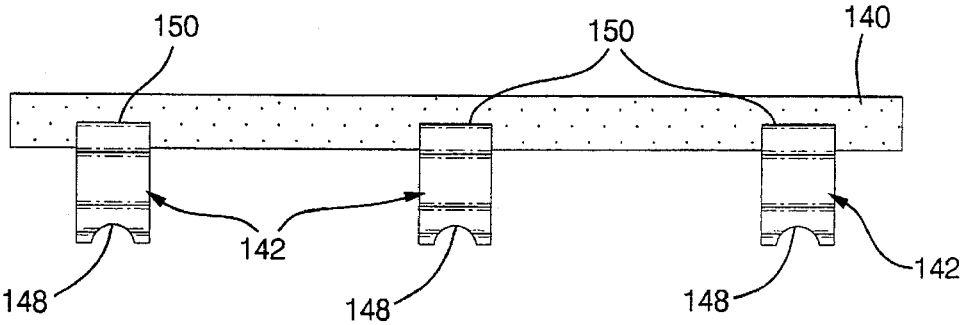
FIG. 7 is a side view taken along reference 5—5 of the upper integrated circuit of FIG. 4.

FIG. 7 illustrates a side view of the IC 140 taken along reference 5—5, detailing the cross-section of pins 142 having horizontal pin section 148 of arcuate shape for seating of pins 28 and having flat pin section 150. The arcuate shape of section 148 should correspond generally to the pin 28 circumference shape so that the pins 28 may be seated into the arcuate shaped section 148 with maximum contact surface area to ensure reliable electrical conductivity between the pins 28 and corresponding pin sections 148 in accord with this embodiment.

Figure 5:
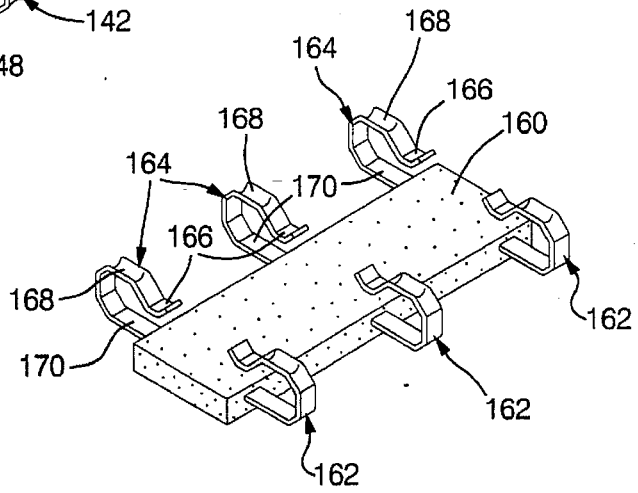
FIG. 5 is an orthogonal view of a lower integrated circuit containing capacitive circuit elements to be incorporated into the filter housing of FIG. 2.

Referring to FIG. 5, flat rectangular integrated circuit IC 160 of a conventional dual in-line package mechanization, having a design corresponding to that of FIG. 4 but rotated laterally 180 degrees (an upside-down orientation of the IC 140). Each of a plurality of electrically conductive pins or leads 162 and 164 extend from the IC 160 in a flat pin section 170 leading to a "U" shaped section into a horizontal section 168 of arcuate cross-section forming a pin seat for seating one of the pins 28, bending into an inner horizontal section 166. The IC 160 is sized for slideable insertion into lower cavity 86 of filter housing 26 of FIG. 2, along the length thereof, between the flat plate 90 and the recess 106, seated between edges 104. The pins 162 and 164 may be constructed of a conventional, electrically conductive resilient spring steel material, such as stainless steel.

Figure 8:
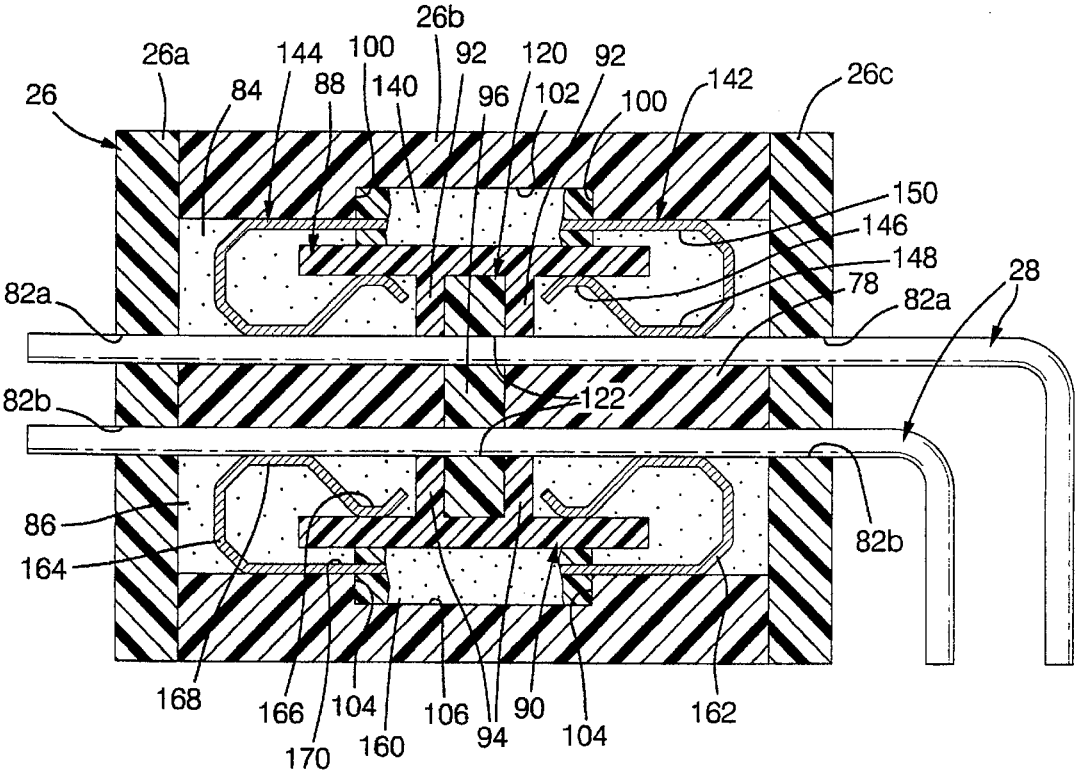
FIG. 8 is a front view of the filter housing of FIG. 2 taken along reference 8—8.

Referring to FIG. 8, a front cutaway view of the housing 26 of FIG. 2, taken along reference 8—8 illustrates the assembled filter housing assembly with pins 28 passing therethrough. IC 140 is slideably installed between upper plate 88 and recess 102 between edges 100, with pins 28 seated in a spring loaded manner in arcuate cross-section of horizontal section 148 of pins 142 and 144, forming a reliable electrical contact between the pins 142 and 144 and pins 28. Inner horizontal pin section 146 rests against upper plate 88 and the flat pin section 150 rests against housing center section **26*b* to minimize movement of the pins 142 and 144. Ferrite block 120 is slideably installed in slot 96 between legs 92 of upper plate 88 and between legs 94 of lower plate 90. Likewise, IC 160 is slideably installed between lower plate 90 and recess 106 between edges 104, with pins 28 seated in a spring loaded manner in arcuate cross-section of horizontal section 168 of pins 162 and 164, forming a reliable electrical contact between the pins 162, 164 and pins 28. Inner horizontal pin section 166 rests against lower plate 90 and the flat pin section 170 rests against housing center section 26*b* to minimize movement of the pins 162 and 164**.

The number of pins 142 and 162 may correspond to the number of respective upper passages **82*a* and to the number of lower passages 82*b* of the filter housing 26 of FIG. 2. The number of pins 144 and 164 correspond, respectively, to the number of pins 142 and 162. The passages 82*a* are aligned with the horizontal pin section 148 seats and the passages 82*b* are aligned with the horizontal pin section 168 seats, such that the L-shaped pins 28 passing through passages 16 (FIG. 1) and received into filter housing passages 82*a* and 82*b* deflect pins 142 and 162 while being received into the horizontal section 148 and 168 seats, wherein the spring loaded seats are thereby urged against the pins 28 forming a reliable electrical connection therebetween. The L-shaped pins 28 are then inserted through passages 122 of the ferrite block 120 of FIG. 3, and then deflect pin seats 148 and 168 at the opposing side of the ICs 140 and 160, respectively, while seating therein, which seats are thereby urged against the pins 28, forming a reliable electrical connection therebetween. The seats of the pins 144 and 164 are of the shape and construction detailed in FIG. 7. The pins 28 are then passed through the remaining portion of passages 82*a* and 82*b* out of the filter housing 26 and through passages 18 of the connector 10 and into cavity 22** for mating with a corresponding female connector (not shown).

Figure 6:
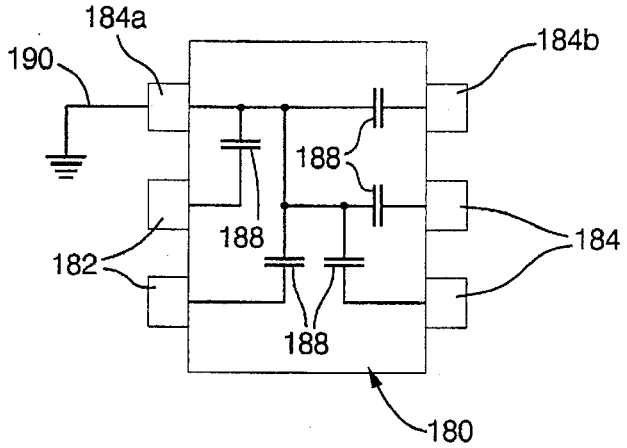
FIG. 6 schematically illustrates the circuitry provided on each of the integrated circuits of FIGS. 4 and 5.

The circuitry details of the ICs 140 and 160 are schematically illustrated by the six terminal IC 180 of FIG. 6. A ground reference 190 is provided on at least one of the pins **184*a* (and 184*b*) of the IC 180. The remaining pins 182 and 184 are connected to this ground reference 190 through integrated capacitor elements 188. In this embodiment, the capacitor elements 188 are selected as standard integrated 1500 picoFarad capacitors. The ground reference 190 may be provided to the IC via one or more pins of the plurality of pins 28 (FIG. 1) which, for example, are wave soldered to a ground reference plane of the printed circuit board 30 of FIG. 1. Therefore, when the ground reference pins from the plurality of pins 28 are seated in seats of pins 184*a* and 184*b*, and when remaining pins of the plurality 28 are seated in seats of pins 182 and 184, the signals on such remaining pins are pulled to ground through one of the capacitors 188. Each of the pins 182 and 184 are thereby provided as a vertical leg of the Pi filter of this embodiment for pulling the filtered signal to a ground reference through a pull down capacitor element 188**.

Figure 3:
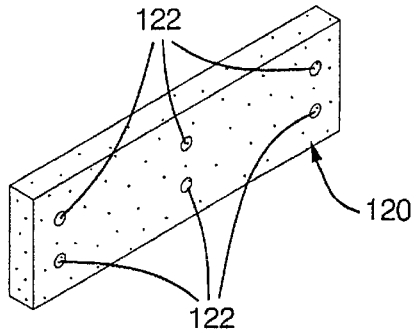
FIG. 3 is an orthogonal view of the ferrite block integrated into the filter housing of FIG. 2.

Still further, when the ferrite block 120 of FIG. 3 is fully inserted into the slot 96 and seated between legs 92 of upper plate 88 and legs 94 of lower plate 90 as described, and when the ICs 140 and 160 are inserted fully into respective upper and lower cavities 84 and 86 respectively, as described, a low cost, solderless, low pass filter of a conventional Pi filter configuration is provided in a convenient, solderless package integrated into connector assembly 10 of FIG. 1 using integrated capacitive elements and reliable electrical interfaces. The signals on those of the pins 28 of FIG. 1 requiring filtering, such as low pass filtering, are pulled down through an integrated capacitor element 188 (FIG. 6) to a ground reference provided on ground reference pins **184*a* and 184*b* of the plurality of pins 28 in a first filter stage, by seating the pins 28 on the seats (such as illustrated by seats 200 of FIG. 7) of pins 142 and 162. The signals on the pins 28 requiring filtering are next passed through passages 122 of ferrite block 120 (FIG. 3) to provide a series inductance filter stage (the second filter stage). The signals are then pulled down to the ground reference via an integrated capacitor element 188 provided by seating the pins 28 on seats of IC pins 144 and 164 (FIGS. 4 and 5) in a third filter stage. The low pass filtered signals may then be passed through for interface with the female terminals of the connector (not shown) mated to the connector 10 of FIG. 1. Likewise, incoming signal information passing from the mating female connector (not shown) to the connector 10 of FIG. 1 may be low pass filtered via the described solderless, low cost filter process provided in this embodiment before being passed from pins 28 to circuit elements (not shown) of the printed circuit board 30 (FIG. 1**).

It should be pointed out that a number of variations of the structure described for the preferred embodiment for the purpose of explaining and not limiting this invention are readily available to those possessing ordinary skill in the art. For example, the first and third filter stages may be implemented as separate integrated circuit devices having, for example, single in-line package SIP mechanizations. A first SIP containing the described first filter stage may have modified conductive leads or pins corresponding to those of the preferred embodiment (for example, corresponding to pins 142 of FIG. 4). Such first SIP may be inserted into a modified filter housing (not shown) disposed in enclosure 34 of FIG. 1 during a filter assembly process. A second SIP containing the described third filter stage may likewise have modified conductive pins or leads corresponding to those of the preferred embodiment, such as pins 144 of FIG. 4, and may be inserted in a separate cavity in the modified filter housing or alternatively in a housing installed in the female connector (not shown) to which the connector assembly 10 of FIG. 1 is mated. The modified filter housing may include a passage for receiving ferrite block 120 of FIG. 3 for providing a series inductance filter stage the described second filter stage), or the passage for the ferrite block may be provided in a similar passage in the housing provided for the female connector including the second integrated circuit package. Still further, the horizontal length of L-shaped pins may be shortened to provided for the low-contact force male-to-male connector interface described in the copending U.S. application Ser. No. 08/571,622, filed on the date of filing of the instant application, attorney docket number H169839, assigned to the assignee of this application. For example, the spring assembly using a coil spring of the copending U.S. application may be installed in the ferrite block 120 of FIG. 3 and male pins inserted from both mating male connectors into passages 122 of the block 120 on opposing sides thereof for spring loaded electrical contact therein.

The preferred embodiment for the purpose of explaining a preferred working example of this invention is not intended to limit or restrict the invention since many modifications may be made through the exercise of ordinary skill in the art without departing from the scope of the invention.

The embodiments of the invention in which a property or privilege is claimed are described as follows:

1. A solderless filter circuit for filtering electrical signals carried by electrical conductors, the filter circuit contained in a connector assembly including at least two mating connectors and comprising:

a housing having at least one filter passage therethrough;

the at least one filter passage sized to receive a corresponding electrical conductor therein;

an inductive element retained in the housing adjacent the at least one filter passage and in position to electrically contact the electrical conductor received in said at least one filter passage;

an integrated capacitor circuit retained in the housing and comprising, corresponding to each filter passage in the housing, at least one capacitor element with first and second electrical terminals; and at least one of the electrical terminals of each capacitor element being adjacent the corresponding filter passage and having a conductor seat thereon for seating an electrical conductor received in the corresponding filter passage, wherein the electrical conductor received in said filter passage makes electrical contact with the inductive element for applying an inductive load to electrical signals carried by said electrical conductor, and is seated in the conductor seat of the corresponding terminal of the corresponding at least one capacitor element, for applying capacitive filtering to electrical signals carried by said electrical conductor.

2. The solderless filter circuit of claim 1, wherein the inductive element is a ferrite block having, corresponding to each filter passage in the housing, a passage therethrough, wherein each ferrite block passage is aligned with its corresponding filter passage in the housing; and each ferrite block passage sized to receive a corresponding electrical conductor therethrough and sized to make electrical contact with the corresponding electrical conductor to provide a series inductive load to electrical signals carried by the corresponding electrical conductor.

3. The solderless filter circuit of claim 1, wherein the second electrical terminal of each capacitor element is substantially maintained at an electrical ground reference voltage, and wherein the first electrical terminal of each capacitor element extends from the integrated capacitor circuit in the form of an electrically conductive lead having a conductor seat thereon for seating the electrical conductor received in the corresponding filter passage.

4. The solderless filter circuit of claim 3, wherein each electrically conductive lead is of a semicircular cross-section aligned, when the integrated capacitor circuit is retained in the housing, with the corresponding filter passage, wherein each electrical conductor is received in its corresponding filter passage and is seated in the semicircular cross-section of the corresponding electrically conductive lead.

5. The solderless filter circuit of claim 1, wherein the integrated capacitor circuit comprises a pair of capacitor elements corresponding to each filter passage.

6. The solderless filter circuit of claim 5, wherein the second electrical terminal of each capacitor element is maintained substantially at a ground reference voltage and the first electrical terminal of each capacitor element comprises an electrically conductive lead with a conductor seat thereon extending from the integrated capacitor circuit, for seating and maintaining electrical contact with a conductor received in the corresponding filter passage.

7. The solderless filter circuit of claim 6, wherein the conductor seats of each pair of capacitor elements maintain electrical contact at spaced first and second contact positions along a conductor received in the corresponding filter passage, and wherein the inductive element is positioned in the housing to electrically contact each conductor received in its corresponding filter passage between the spaced first and second contact positions, thereby forming a Pi filter configuration for each conductor received each corresponding filter passage.

8. The solderless filter circuit of claim 1, further comprising:

an additional housing having at least one filter passage therethrough aligned with the at least one filter passage of the first recited housing;

the at least one filter passage of the additional housing sized to receive the electrical conductor therethrough; and an additional capacitor circuit retained in the additional housing and having, for each filter passage of the additional housing, a corresponding capacitor element with first and second electrical terminals, the first electrical terminal substantially maintained at a ground reference voltage and the second electrical terminal having a conductor seat thereon for seating an electrical conductor received in the corresponding filter passage of the additional housing, wherein an electrical conductor received in the filter passage of the additional housing makes electrical contact with the conductor seat of the corresponding capacitor element, for applying capacitive filtering to the electrical signals carried thereby.

9. The solderless filter circuit of claim 8, wherein the first recited housing is retained in a first of the two mating electrical connectors and wherein the additional housing is retained in a second of the two mating electrical connectors.

10. A header connector assembly including at least two matched connectors having electrical leads which are electrically coupled when the at least two connectors are mated together, the header connector assembly including a filter circuit for filtering electrical signals carried by the electrical leads, the filter circuit comprising:

a housing retained in the header connector assembly;

the housing having a plurality of passages, each of the plurality positioned and sized to receive a corresponding one of the electrical leads through a predetermined length of the passage;

a solderless integrated capacitor circuit retained in the housing and having a multiplicity of capacitors integrated thereon, each of the multiplicity having first and second electrically conductive terminals with a capacitance therebetween, each first terminal having a concave seat across the terminal width for seating a corresponding electrical lead;

each concave seat aligned with a corresponding housing passage; and at least one solderless inductor element retained in the housing and positioned in the housing to electrically contact each electrical lead received through the passages of the housing to apply an inductive load to electrical signals carried by the electrical leads received through such passages of the housing, wherein solderless signal filtering is provided for electrical signals carried by the electrical leads when said leads are received through the passages of the housing, seated in the corresponding concave seat, and electrically contacting the at least one inductive element, through the application of capacitive and inductive loads to said electrical signals.

11. The header connector assembly of claim 10, wherein the second electrically conductive terminals are electrically connected to a ground reference voltage.

12. The header connector assembly of claim 11, wherein two concave seats of two capacitors are aligned with each housing passage providing, for each electrical lead received through a corresponding housing passage and seated in the two concave seats aligned with such corresponding housing passage, a first and a second electrical path to the ground reference voltage through the capacitance of each of the two capacitors.

13. The header connector assembly of claim 12, wherein the at least one solderless inductor element comprises:

a ferrite block having a series of passages therethrough, each of which series of passages is aligned with a corresponding housing passage, and each of which series of passages is sized to receive the electrical lead that passes through the predetermined length of the corresponding housing passage, thereby providing a solderless series inductive load to electrical signals carried by the electrical leads.

14. The header connector assembly of claim 13, wherein the ferrite block is positioned in the housing so that the series inductive load provided to electrical signals carried by the electrical leads is applied between the first and the second electrical path to the ground reference voltage, thereby providing for low pass filtering of the electrical signals in a Pi filter configuration.

* * * * *